US005336014A

United States Patent [19]

Keller

[11] Patent Number: 5,336,014

[45] Date of Patent: Aug. 9, 1994

[54] MANUALLY OPERATED DISPENSING APPLIANCE, IN PARTICULAR FOR A DOUBLE DISPENSING CARTRIDGE FOR TWO-COMPONENT SUBSTANCES

[76] Inventor: Wilhelm A. Keller, Obstgartenweg 9, CH-6402 Merlischachen, Switzerland

[21] Appl. No.: 978,119

[22] Filed: Nov. 18, 1992

[30] Foreign Application Priority Data

Nov. 18, 1991 [CH] Switzerland ..... 03359/91

[51] Int. Cl.[5] ..... B05C 17/005

[52] U.S. Cl. ..... 403/24; 403/25; 222/153; 222/137

[58] Field of Search ..... 222/137, 153, 135, 136, 222/145; 403/24, 25

[56] References Cited

U.S. PATENT DOCUMENTS

| | | | |
|---|---|---|---|
| 3,767,085 | 10/1973 | Cannon et al. | 222/137 |
| 4,865,229 | 9/1989 | Schneider et al. | 222/325 |
| 4,871,088 | 10/1989 | Cox | 222/47 |
| 4,880,143 | 11/1989 | Murray et al. | 222/135 |
| 5,064,098 | 11/1991 | Hutter, III et al. | 222/137 |
| 5,161,715 | 11/1992 | Giannuzzi | 222/135 |
| 5,203,839 | 4/1993 | Skaggs | 222/137 |
| 5,215,226 | 6/1993 | Bertram et al. | 222/135 |

FOREIGN PATENT DOCUMENTS

| | | | |
|---|---|---|---|
| 3920694 | 1/1991 | Fed. Rep. of Germany | 222/137 |
| 2019952 | 11/1979 | United Kingdom | 222/145 |

*Primary Examiner*—P. Austin Bradley
*Assistant Examiner*—Erik R. Puknys
*Attorney, Agent, or Firm*—Ostrolenk, Faber, Gerb & Soffen

[57] ABSTRACT

In a manually operated dispensing appliance for a double dispensing cartridge for two-component substances, said cartridge in plugged onto said appliance by means of a flange. For the purpose of a solid attachment of said cartridge to the housing of said appliance, a securing flap is provided which is hinged on said housing and comprises a locking portion which engages behind the upper edge of said attaching flange as well as a portion which engages in a recess of said housing and whose end is shaped as an articulation. A manual dispensing appliance having such a nonlosable securing flap is more reliable in operation and will not drip when the trigger lever is released.

14 Claims, 4 Drawing Sheets

MANUALLY OPERATED DISPENSING APPLIANCE, IN PARTICULAR FOR A DOUBLE DISPENSING CARTRIDGE FOR TWO-COMPONENT SUBSTANCES

In a manually operated dispensing appliance having a double dispensing cartridge, the latter is generally plugged onto said appliance, the double cartridges of known appliances being provided with a flange of which at least three sides are insertable in a corresponding slot of the appliance. When the trigger lever of manually operated appliances for cartridges with two-component substances is actuated, substantial forces are produced which may lead not only to an expansion of the two cartridges, but also to a bending of the flange connecting the two cylinders of said cartridge. When the trigger lever is released, the return of said flange to its starting position results in an additional pressure on the enclosed substance and increases its tendency to flow out. Therefore, the prevention of said flange bending is an important factor for a precise operation of dispensing appliances. Furthermore, an enclosure on three sides of said flange results in an undesirable downward tilt of said cartridge.

In order to prevent any bending of said flange, appliances are being marketed which are provided with means in order to enclose said flange in the manual appliance on all sides. These means consist of a snap arrangement which is conformed as an individual part and on one side encloses the flange of the double cartridge and on the other side the rear portion of said manual appliance, where it is secured by snap means. Since said snap arrangement is conformed as a detachable part, it is possible that the user will misplace this part or consciously fail to use it in order to save time, whereby a proper operation of the manual appliance may no longer be guaranteed.

On the background of the above prior art, it is the object of the present invention to create a manually operated appliance which is provided with means in order to safely secure the double cartridge on said manual appliance without the risk of losing said securing means. This object is attained by means of a manually operated dispensing appliance, in particular for a double dispensing cartridge for two-component substances, said cartridge being insertable by a flange in said appliance, and means being provided in order to attach said cartridge to said appliance, wherein said attaching means comprise a securing flap which is hinged on the housing of said appliance.

The invention is explained in more detail hereinafter with reference to a drawing of embodiments.

Figure 2:
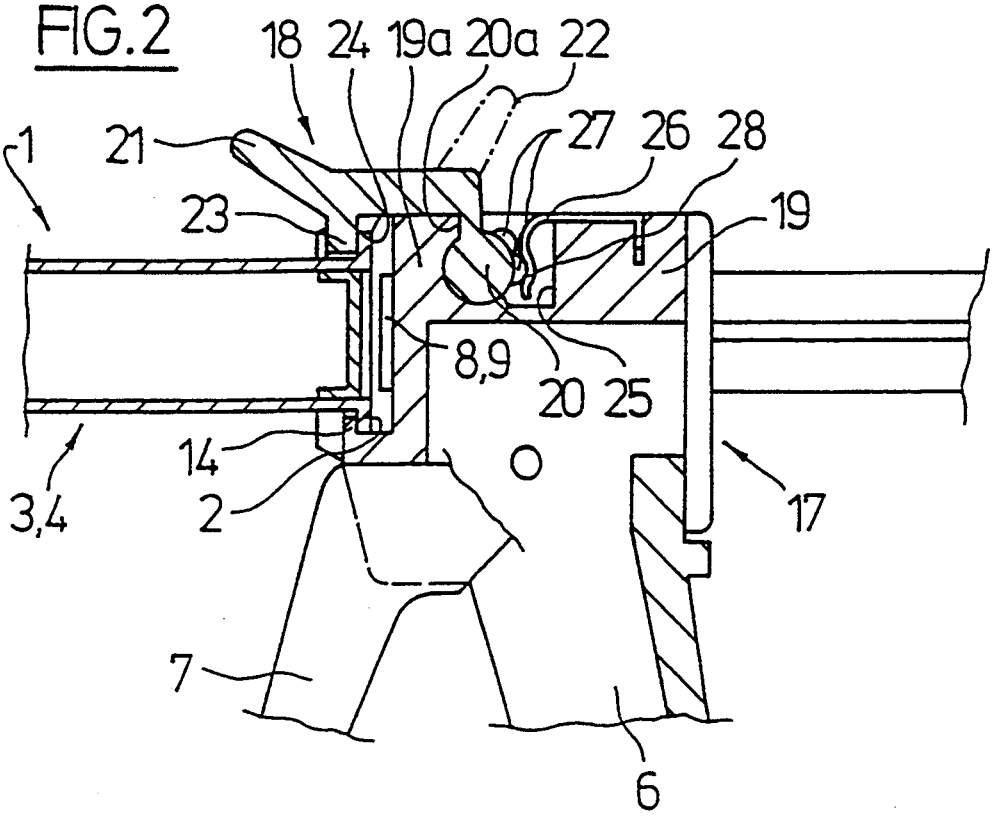
FIG. 2 shows a first embodiment of a manual appliance according to the invention in a sectional view.
Figure 3:
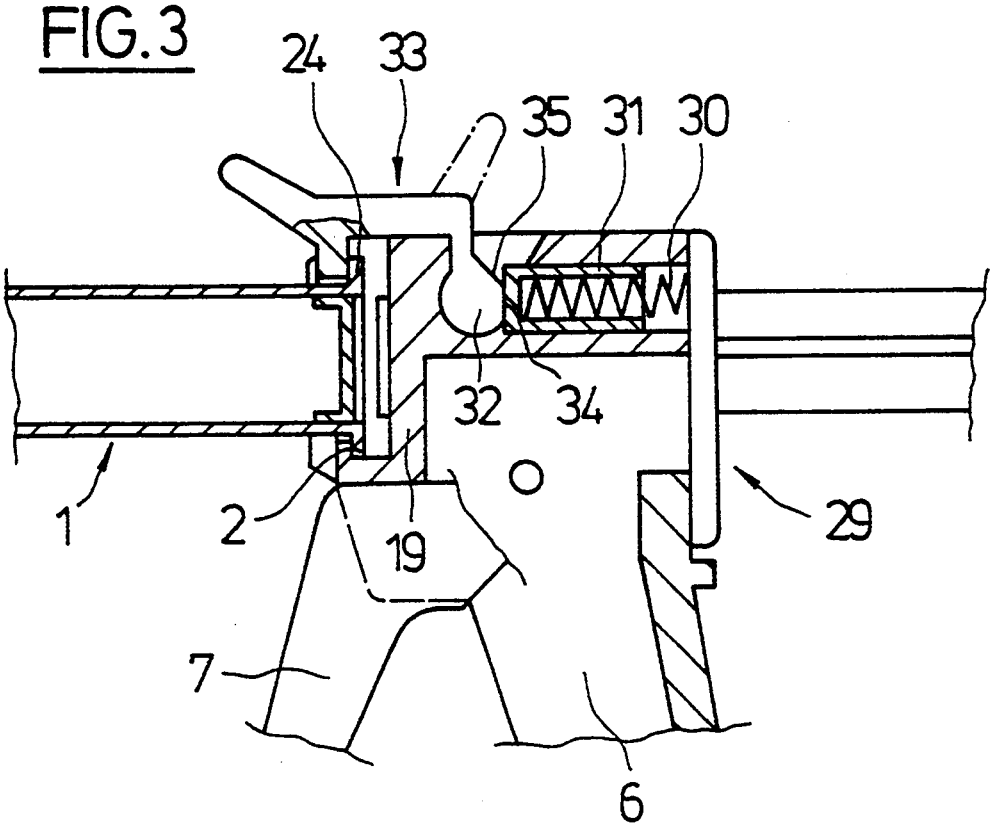
FIG. 3 shows an alternative embodiment of FIG. 2.
Figure 3A:
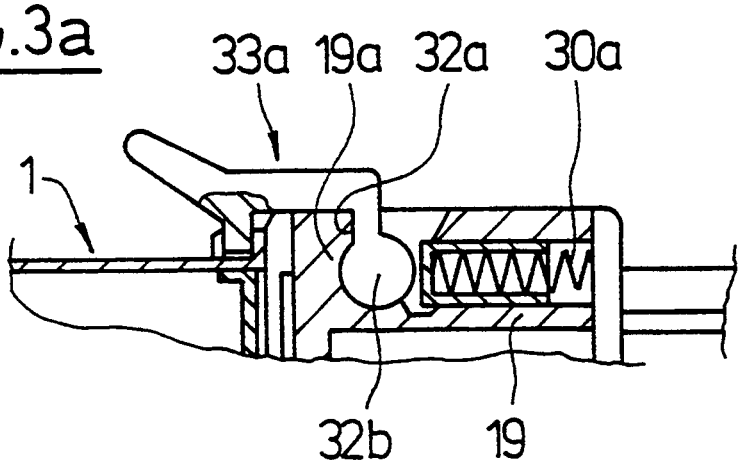
Figure 4:
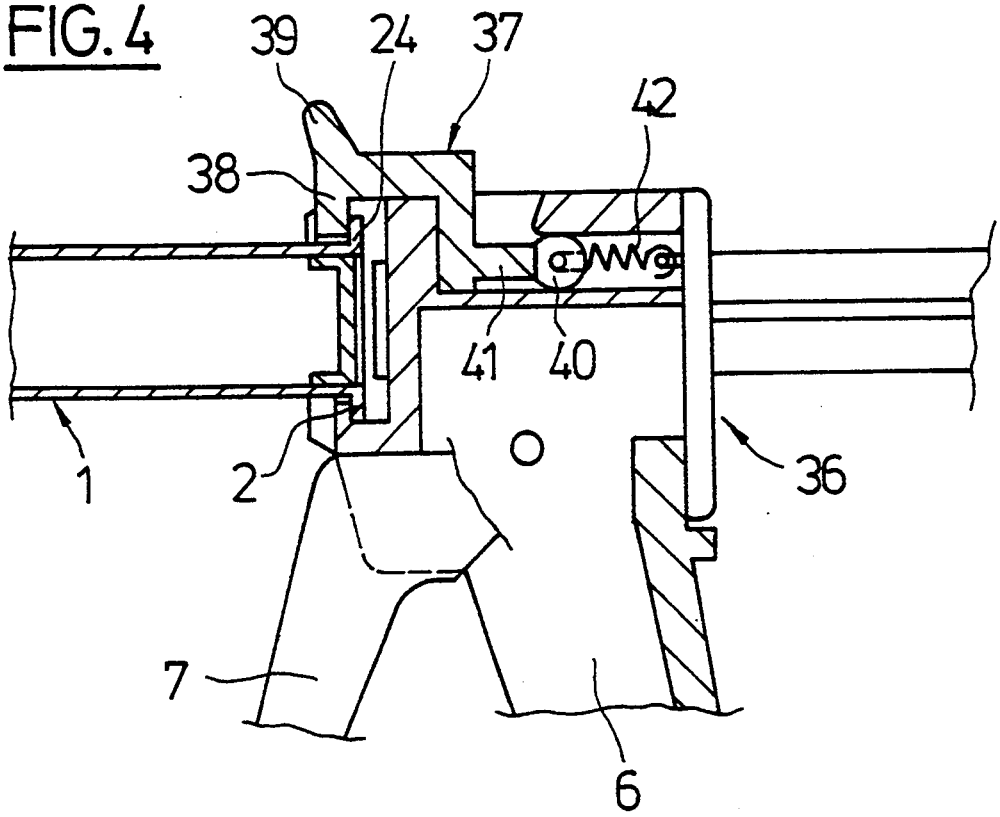
Figure 5:
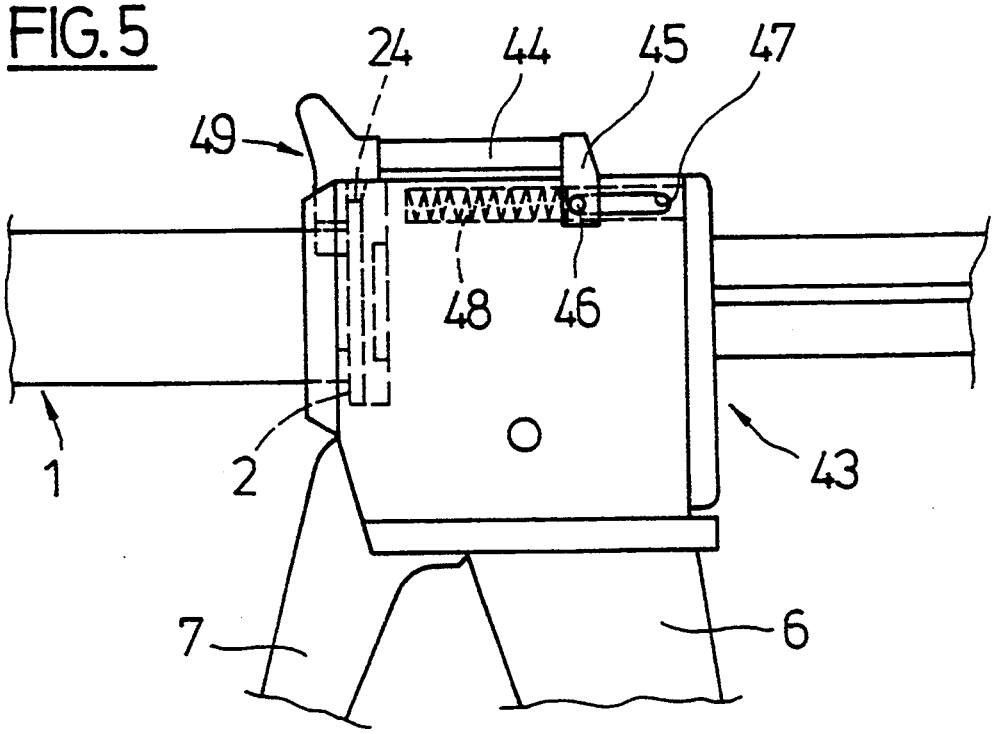
Figure 6:
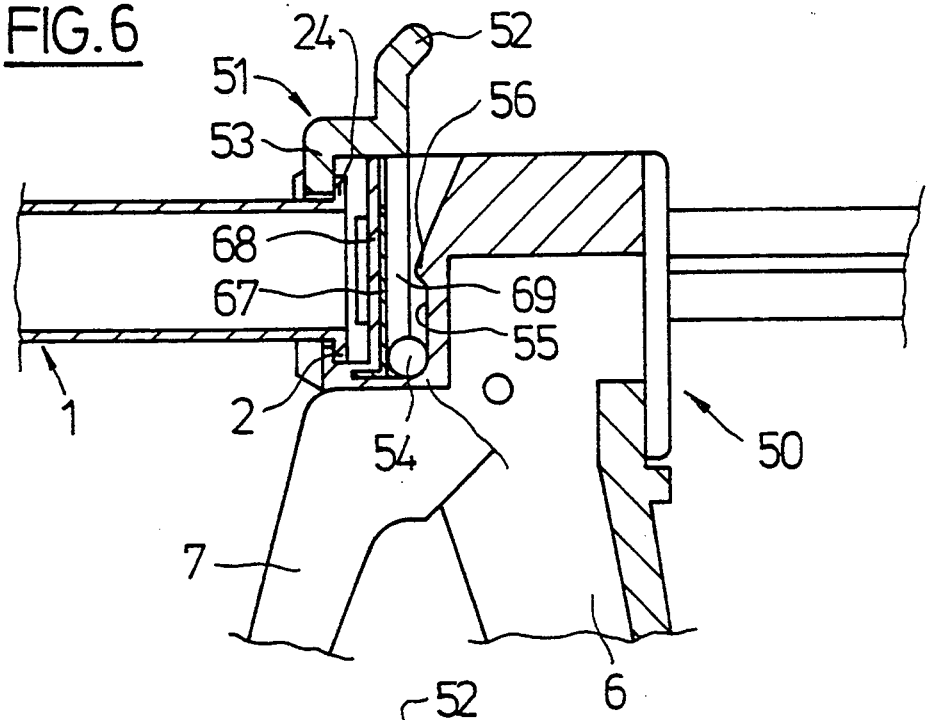
Figure 7:
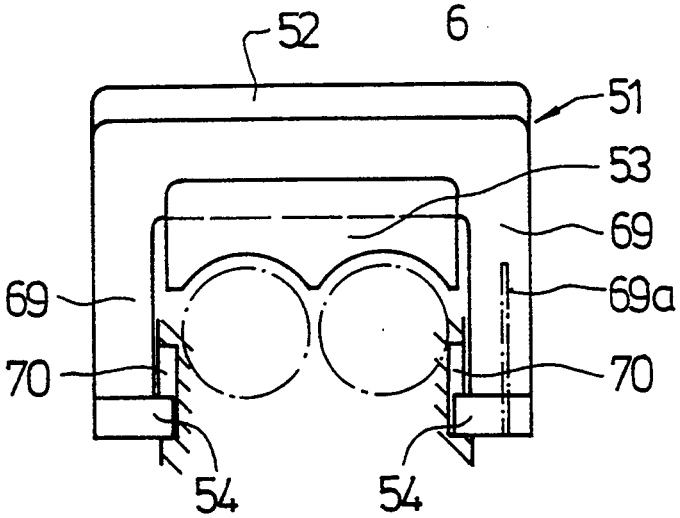
Figure 8:
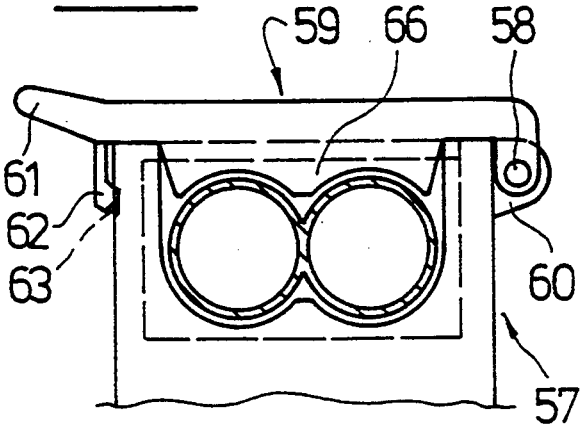

FIG. 3*a* shows another alternative embodiment of FIG. 2;

FIG. 4 shows a second embodiment in a sectional view;

FIG. 5 shows an alternative of the embodiment of FIG. 4 in a side elevation;

FIG. 6 shows a section of a third embodiment;

FIG. 7 shows a front view of a detail of the appliance according to FIG. 6;

FIG. 8 shows a front view of a fourth embodiment; and

Figure 9:
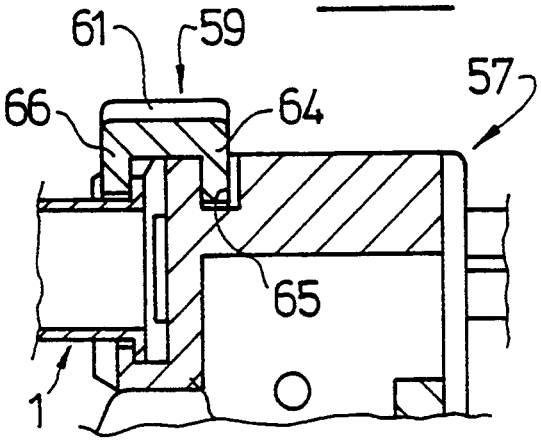

FIG. 9 shows a longitudinal section of the appliance of FIG. 8.

Figure 1:
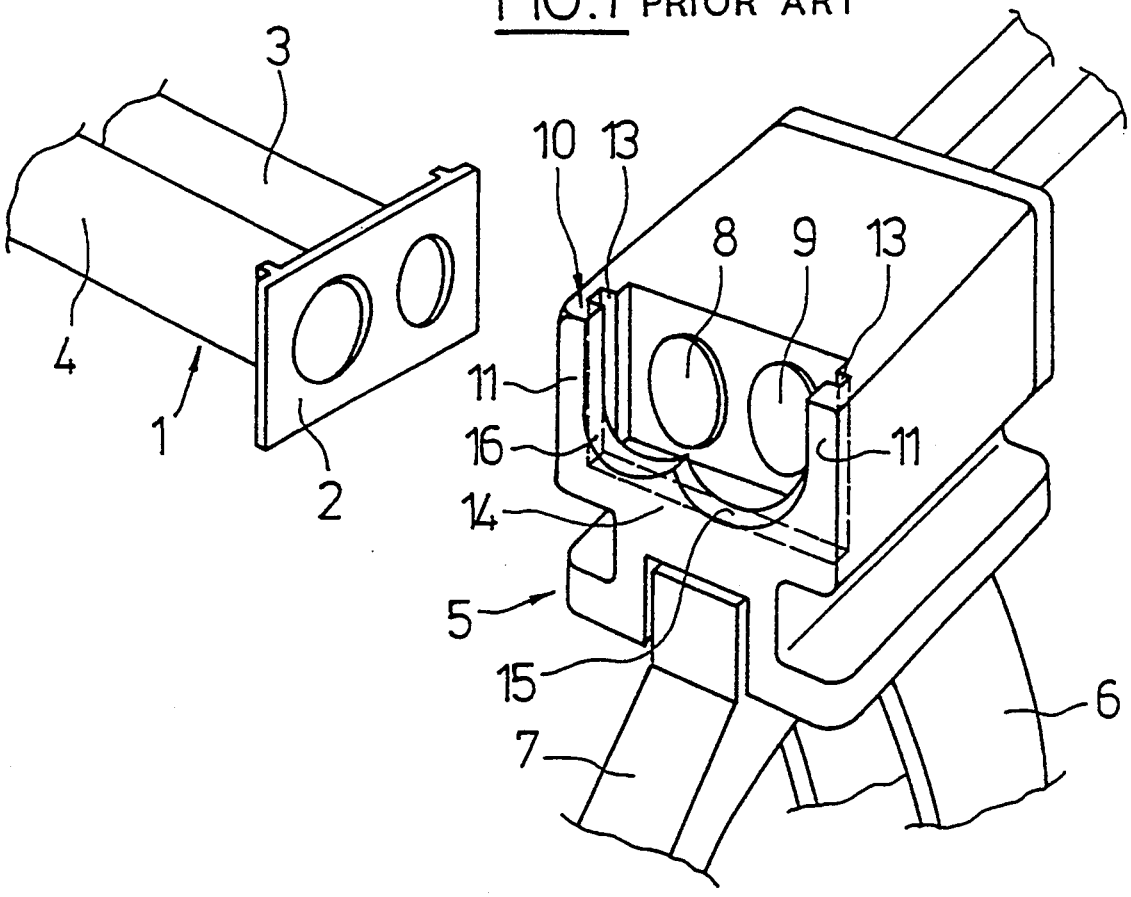
FIG. 1 PRIOR ART
FIG. 1 shows a prior art manual appliance without securing means in a perspective view.

Of the known manual appliance shown in FIG. 1, only the essential parts which are relevant for understanding the invention are illustrated. Thus, only the end portion of double cartridge 1 with flange 2 is shown, while it appears in the figure that cylinder 3 at the right is smaller in diameter than cylinder 4. The ratio of the cylinder diameters may vary from 1:1 to 1:10. Manual appliance 5 is provided with a handle 6 and a trigger lever 7 which through a gear mechanism drives two thrust rods whose thrust pieces 8 and 9 actuate the dispensing pistons in the cartridge cylinders. The front side of the manual appliance, facing the cartridge, is provided with a cartridge holder rim 10 where the flange of said cartridge can be inserted. The two sides 11 and 12 of the holder comprise each a slot 13 while the lower side 14 is provided with two arcuate cutouts 15 and 16 on which at least one of the two cylinders of said cartridge comes to rest and behind which the lower side of flange 2 is received. Correspondingly, the same applies for pneumatically or electrically driven dispensing appliances.

It follows from the preceding that the cartridge, i.e. its flange is held on three sides. As already stated in the introduction, such a three-sided enclosure of the cartridge flange is often insufficient in order to keep the latter from being bent during the dispensing operation. The known, stirrup-shaped securing means, which encloses said flange, on one hand, and the upper portion of the housing of the appliance, on the other hand, and secures said flange to said housing, is disadvantageous in that said stirrup may easily be lost or misplaced.

A first embodiment of the appliance 17 of the invention according to FIG. 2 is provided with a securing flap 18 which is hinged on the upper side of housing 19 of said appliance. Securing flap 18 has a thickening 20 on one leg which serves as an articulation. As desired, an upper leg 21 or 22 serves as a handle portion in order to allow to lock or release said securing flap, while another, short leg 23 is shaped as a locking portion which engages behind flange 2 of said double cartridge. Articulation 20 is accommodated in a recess 25 of housing 19, in which a spring 26 is disposed which acts upon said articulation. Between articulation 20 and said handle portion, said securing flap is provided on the cartridge side with a recess 20*a* and said housing with a corresponding shoulder 19*a* in order to retain said flap. Meanwhile, said spring acts upon two knobs 27 of said articulation to which an indentation 28 in the free leg of said spring corresponds, whereby a defined locked and open position of said securing flap is obtained, respectively.

In FIG. 3, an alternative embodiment of FIG. 2 is illustrated where manual appliance 29 is provided with a pressure or compression coil spring 30 instead of a leaf spring 26 having a U-shaped profile, said pressure spring 30 being partially lodged in a slidable sleeve 31 in order to push the latter against articulation 32 of securing flap 33. In this embodiment as well, the articulation is provided with a recess 32*a* and the housing with a corresponding shoulder 19*a*. Said articulation is provided with two plane surfaces 34 and 35 in order to maintain said securing flap in two defined end positions. The operation and effect of both securing flaps 18 or 33 is the same, and both have defined locked and open positions and are capable of holding said double cartridge even at high dispensing pressures. It is also possible to make pressure spring 30*a* stronger while said sleeve is acting upon a cylindrical articulation 32*b*, according to FIG. 3*a*, so that the movement of securing flap 33*a* is fixed merely by friction rather than by detents as in the embodiments of FIGS. 2 and 3.

Manual appliance 36 according to FIG. 4 is provided with a securing flap 37 whose locking leg 38 is the same as in the previous embodiments, but which has only one handle portion 39. Articulation 40 of the securing flap of this embodiment is not formed directly on the leg thereof, but on a web 41 extending in parallel to said cartridges and thrust rods. Articulation 40 is under the action of a tension spring 42 whose other end is hinged on the housing. When the securing flap is opened, it is retracted and locked by said tension spring.

Manual appliance 43 according to FIG. 5 is a space-saving alternative of the previous one according to FIG. 4, web 44 being disposed outside the housing and having an end portion 45 which is U-shaped in cross-section and which slides in a slot 47 of said housing by a through-going axle 46. Axle 46 is under the action of a pressure spring 48 which is accommodated in said housing and which also serves the purpose of bringing securing flap 49 to a defined open position and maintaining it there.

Manual appliance 50 according to FIGS. 6 and 7 features a securing flap 51. Said securing flap 51 is about U-shaped in cross-section and has a handle portion 52 as well as locking portion 53 for engagement behind flange 2 of the double cartridge. Handle portion 52 is connected to shanks 69 with hinge pins 54 (FIG. 7) which are accommodated in corresponding grooves 70 of a recess 55 of the housing of said appliance and are disposed behind a projection 56 which ensures that said flap may not fall off. Respective leaf springs 67 are disposed between housing 68 and shanks 69 of securing flap 51. In order to release the securing flap, it is first pulled up to stop 56 by said handle portion, whereby said flange is released by locking portion 53 and spring 67 brings said locking portion to the open position.

In order to facilitate the insertion of said securing flap past projection 56, it may be useful to provide the two shanks 69 with a respective slit 69*a* in order to increase their elasticity.

While the rotation axis of all the previously described embodiments of the securing flap is disposed transversally with respect to the extension of the cylinders and the thrust rods, axle 58 of manual appliance 57 according to FIGS. 8 and 9 is disposed in parallel to the cartridges and thrust rods. At its end opposite articulation 60 with rotation axle 58, securing flap 59 is provided with an elastic bar 62 which is adapted to snap into a recess 63 of the housing. As appears in particular in FIG. 9, said securing flap 59 is U-shaped in cross-section, one shank being formed by locking portion 66 while the other shank 64 engages in a groove 65 behind the housing, whereby a strong locking of the double cartridge is achieved.

All of said securing flaps have in common that they are hinged on the housing and cannot be lost accidentally, and that they are conformed in such a manner as to fasten said double cartridge firmly to said housing.

I claim:

1. A manually operated dispensing appliance for a double dispensing cartridge for two-component substances, said appliance including a housing, said cartridge including an attaching flange and being mountable to said appliance by inserting said attaching flange into a cooperating formation of said housing, and attaching means for securing said cartridge to said appliance, said attaching means including a securing flap and an articulation formed by a hinge axle by which said securing flap is hinged on said housing, said hinge axle extending transverse to the longitudinal axis of said cartridge, spring means on said housing, said articulation being influenced by action of said spring means in order to bring said securing flap to a defined position.

2. The appliance of claim 1, wherein said securing flap comprises a locking portion which engages said housing behind an upper edge of said attaching flange of said cartridge, as well as a portion which engages in a recess of said housing.

3. The appliance of claim 1, wherein said securing flap has defined locked and open positions.

4. The appliance of claim 1, wherein said articulation is cylindrical and said spring means is made stronger in order to create a frictional engagement on said cylindrical articulation.

5. The appliance of claim 1, wherein said articulation is provided with means which cooperate with said spring means in order to establish defined locked and open positions for said securing flap.

6. The appliance of claim 2, wherein said securing flap comprises an upper leg serving as a handle portion, a leg facing said cartridge and serving as a locking portion, as well as another leg having an end at which said portion which engages in said recess is located, said end being conformed as said articulation.

7. A manually operable dispensing appliance for a double dispensing cartridge;

said appliance including a housing, and said cartridge including an attaching flange;

said cartridge being mountable to said appliance to extend outward thereof by inserting said attaching flange into a cooperating formation of said housing;

an attaching means including a securing flap mounted to said housing for movement between locking and open positions;

a relatively short leg and a relatively long leg, spaced from said short leg, said legs being connected by said securing flap;

with said securing flap in said locking position said securing flap extending over an upper edge of said flange, said legs extending downward from said flap, said short leg being outward of said flange and said long leg being inward of said flange, said long leg extending to a lower point than said short leg, and said short leg having a locking portion engaging said housing;

with said flap in said locking position said flange being maintained in said cooperating formation and with said flap in said open position said flap being clear of said flange to permit said cartridge to be mounted and dismounted from said appliance.

8. The appliance of claim 7 also including a hinge axle by which said securing flap is mounted to said housing; said hinge axle providing a pivot that extends parallel to longitudinal axes of cartridges in said double dispensing cartridge.

9. The appliance of claim 8 in which said hinge axle is at one end of said securing flap; and at its end opposite said one end said securing flap being provided with an elastic bar which engages in a corresponding recess of said housing when said securing flap is in said locking position.

10. The appliance of claim 7, also including a hinge axle by which said securing flap is mounted to said housing; said hinge axle providing a pivot that extends transverse to longitudinal axes of cartridges in said double dispensing cartridge.

11. The appliance of claim 10 in which there is an articulation formed by said hinge axle, said articulation being on said long leg at its end remote from said securing flap.

12. The appliance of claim 11 in which the articulation engages in a recess of said housing.

13. The appliance of claim 11 in which said locking portion engages said housing outward of and below an upper edge of said attaching flange; said locking portion being on said short leg at a location remote from said flap.

14. The appliance of claim 12 in which said long leg is formed as spaced first and second elastic shanks along opposite sides of said flap; and each of said shanks at its free end having a section of said articulation.

* * * * *